US009576538B2

(12) United States Patent
Baek et al.

(10) Patent No.: US 9,576,538 B2
(45) Date of Patent: Feb. 21, 2017

(54) DISPLAY APPARATUS AND LIQUID CRYSTAL DISPLAY APPARATUS

(71) Applicant: SAMSUNG DISPLAY CO., LTD., Yongin, Gyeonggi-Do (KR)

(72) Inventors: Yun-Ki Baek, Yongin (KR); Jung-Taek Kim, Yongin (KR); Yong-Jun Jang, Yongin (KR); Nam-Gon Choi, Yongin (KR); Joon-Chul Goh, Yongin (KR); Ah-Reum Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 334 days.

(21) Appl. No.: 14/197,140

(22) Filed: Mar. 4, 2014

(65) Prior Publication Data

US 2015/0070406 A1 Mar. 12, 2015

(30) Foreign Application Priority Data

Sep. 12, 2013 (KR) ..... 10-2013-0109973

(51) Int. Cl.
*G09G 3/34* (2006.01)
*G09G 3/36* (2006.01)

(52) U.S. Cl.
CPC ..... *G09G 3/3406* (2013.01); *G09G 3/3611* (2013.01); *G09G 2320/0242* (2013.01); *G09G 2320/0276* (2013.01); *G09G 2320/0666* (2013.01); *G09G 2320/0673* (2013.01); *G09G 2360/144* (2013.01)

(58) Field of Classification Search
CPC ..... G09G 3/3406; G09G 2320/0673; G09G 2320/0276; G09G 2320/0242; G09G 3/3611; G09G 2360/144;G09G 2320/0666; G09G 2360/148; G09G 2360/142; G09G 2360/141; G09G 3/2003; G09G 3/3607; G09G 3/2077; G09G 3/2803; G09G 3/288; G09G 345/69; G09G 345/207; G09G 345/89; H04N 3/127; H04N 345/88; H04N 345/102; G02F 1/13357
(Continued)

(56) References Cited

U.S. PATENT DOCUMENTS 8,041,144 B2 10/2011 Kim et al.
2004/0125063 A1 7/2004 Lee et al.
(Continued)

FOREIGN PATENT DOCUMENTS

KR 10-2008-0034690 4/2008
KR 10-0840097 6/2008
(Continued)

*Primary Examiner* — Kumar Patel
*Assistant Examiner* — Amy C Onyekaba
(74) *Attorney, Agent, or Firm* — Lewis Roca Rothgerber Christie LLP

(57) ABSTRACT

A display apparatus includes: a panel including a plurality of pixels configured to display an image; an ambient light sensor configured to sense an illumination level of ambient light and to generate ambient light data; a gamma controller configured to control sections of a reference gamma curve based on the ambient light data to generate a controlled gamma curve, the controlled gamma curve defining output data according to input data; a data driver configured to convert an image signal into a data voltage based on the controlled gamma curve and to supply the data voltage to the pixels; and a gate driver configured to supply a gate signal to the pixels.

15 Claims, 8 Drawing Sheets

(58) Field of Classification Search
USPC ..... 345/690
See application file for complete search history.

(56) References Cited

U.S. PATENT DOCUMENTS

| | | | | |
|---|---|---|---|---|
| 2007/0091082 | A1* | 4/2007 | Huang | G09G 5/02 345/207 |
| 2007/0229435 | A1* | 10/2007 | Lee | G09G 3/2011 345/98 |
| 2008/0089604 | A1 | 4/2008 | Kim et al. | |
| 2008/0198151 | A1 | 8/2008 | Lee et al. | |
| 2008/0310752 | A1* | 12/2008 | Han | G06T 5/20 382/274 |
| 2009/0097775 | A1* | 4/2009 | Monobe | G06T 5/008 382/268 |
| 2010/0066769 | A1* | 3/2010 | Nose | G09G 3/3648 345/690 |
| 2011/0012072 | A1 | 1/2011 | Luecke et al. | |
| 2012/0098848 | A1 | 4/2012 | Choi et al. | |
| 2012/0169792 | A1* | 7/2012 | Yamashita | G02F 1/1336 345/690 |
| 2014/0022287 | A1* | 1/2014 | Ahn | G09G 3/3607 345/690 |
| 2014/0063039 | A1* | 3/2014 | Drzaic | G09G 5/02 345/589 |
| 2014/0225941 | A1* | 8/2014 | Van der Vleuten | G09G 5/006 345/690 |

FOREIGN PATENT DOCUMENTS

| | | | |
|---|---|---|---|
| KR | 10-2009-0011827 | A | 2/2009 |
| KR | 10-0923676 | | 10/2009 |
| KR | 10-2010-0035906 | A | 4/2010 |
| KR | 10-2010-0100954 | | 9/2010 |

* cited by examiner

DISPLAY APPARATUS AND LIQUID CRYSTAL DISPLAY APPARATUS

CROSS-REFERENCE TO RELATED APPLICATION

This application claims priority to and the benefit of Korean Patent Application No. 10-2013-0109973, filed on Sep. 12, 2013, in the Korean Intellectual Property Office, the disclosure of which is incorporated herein in its entirety by reference.

BACKGROUND

1. Field

One or more embodiments of the present invention relate to a display apparatus and a liquid crystal display apparatus.

2. Description of the Related Art

A display apparatus, for example, a liquid crystal display apparatus, controls the light transmittance of a liquid crystal layer through an electric field applied to the liquid crystal layer in response to an image signal to display an image. The liquid crystal display apparatus converts digital video data into an analog data voltage by using a gamma reference voltage and supplies the data voltage to a pixel electrode of a liquid crystal cell. The arrangement of liquid crystal molecules of the liquid crystal cell is changed by the electric field between a pixel electrode to which a data voltage is supplied and a common electrode to which a common voltage is supplied, and thus, the liquid crystal molecules modulate incident light.

An image displayed on a liquid crystal display apparatus may be distorted depending on external conditions such as the illumination level and color of ambient light. If the illumination level of the ambient light is strong, the range of colors of an image displayed through the liquid crystal display apparatus narrows and a color gamut ratio decreases. If the ambient light has a specific color, viewer's eyes are less sensitive to an image having the same color as the ambient fight. For example, under red lighting, a viewer may recognize a red brick as a white brick, not a red brick, because a white object also appears red to the human eyes under red lighting.

SUMMARY

One or more embodiments of the present invention include a display apparatus and a liquid crystal display apparatus that may decrease image distortion without decreasing color gamut ratio.

Additional aspects will be set forth in part in the description which follows and, in part, will be apparent from the description, or may be learned by practice of the presented embodiments.

According to aspects of one or more embodiments of the present invention, a display apparatus includes a panel including a plurality of pixels configured to display an image; an ambient light sensor configured to sense an illumination level of ambient light and to generate ambient light data; a gamma controller configured to control sections of a reference gamma curve based on the ambient light data to generate a controlled gamma curve, the controlled gamma curve defining output data according to input data; a data driver configured to convert an image signal into a data voltage based on the controlled gamma curve and to supply the data voltage to the pixels; and a gate driver configured to supply a gate signal to the pixels.

The sections of the reference gamma curve may be defined such that a color gamut ratio of the panel under an environment having a same illumination level as the ambient light with respect to the input data is lower by certain values than a color gamut ratio of the panel under a darkroom environment.

The sections of the reference gamma curve may be defined according to the illumination level of the ambient light.

The sections of the reference gamma curve may be between a first input value and a second input value larger than the first input value, and the first input value may remain constant or increase as the illumination level of the ambient light increases, and the second input value may remain constant or increase as the illumination level of the ambient light increases.

If the input data is in the sections of the reference gamma curve, a reference output data according to the reference gamma curve may be different from a controlled output data according to the controlled gamma curve, and if the input data is outside the sections of the reference gamma curve, the reference output data according to the reference gamma curve may be equal to the controlled output data according to the controlled gamma curve.

Minimum and maximum values of the input data may be outside the sections of the reference gamma curve.

The controlled gamma curve corresponding to the sections of the reference gamma curve may have a constant slope.

The sections of the reference gamma curve may be between a first input value and a second input value larger than the first input value, a slope of the controlled gamma curve at the first input value may be steeper than a slope of the reference gamma curve at the first input value, the slope of the controlled gamma curve at the second input value may be gentler than a slope of the reference gamma curve at the second input value, and the slope of the controlled gamma curve corresponding to the sections of the reference gamma curve may increase.

The display apparatus may further include a memory configured to store a plurality of controlled gamma curves that are each defined according to an illumination level of the ambient light, and the gamma controller may be configured to select from the memory one of the controlled gamma curves corresponding to the ambient light data.

The ambient light sensor may be an illumination sensor configured to measure the illumination level of the ambient light.

The display apparatus may further include: a backlight configured to emit light from a back of the panel; a comparison unit configured to receive the ambient light data and to compare the illumination level of the ambient light with a preset critical illumination level; and a backlight controller configured to control a luminescence of the backlight based on the illumination level of the ambient light if the illumination level of the ambient light is higher than the critical illumination level.

According to aspects of one or more embodiments of the present invention, a display apparatus includes a panel including first pixels, second pixels, and third pixels; an ambient light sensor configured to measure a first light amount, a second light amount, and a third light amount in ambient light around the panel, the ambient light sensor configured to generate first light amount data corresponding to the first light amount, second light amount data corresponding to the second light amount, and third light amount data corresponding to the third light amount; a gamma controller configured to: control first sections of a first reference gamma curve based on the first light amount data to generate a first controlled gamma curve, control second sections of a second reference gamma curve based on the second light amount data to generate a second controlled gamma curve, and control third sections of a third reference gamma curve based on the third light amount information to generate a third controlled gamma curve; a data driver configured to: convert a first image signal into a first data voltage based on the first controlled gamma curve and to supply the first data voltage to the first pixels, convert a second image signal into a second data voltage based on the second controlled gamma curve and to supply the second data voltage to the second pixels, and convert a third image signal into a third data voltage based on the third controlled gamma curve and to supply the third data voltage to the third pixels; and a gate driver configured to supply a gate signal to the first pixels, the second pixels, and the third pixels.

The first sections may be defined based on the first light amount information, the second sections may be defined based on the second light amount information, and the third sections may be defined based on the third light amount information.

The first sections may be defined such that color space coordinates measured on the panel on which only the first pixels are turned on under a first lighting environment corresponding to the first light amount data vary with respect to color space coordinates measured on the panel on which only the first pixels are turned on under a darkroom environment, the second sections may be defined such that color space coordinates measured on the panel on which only the second pixels are turned on under a second lighting environment corresponding to the second light amount data vary with respect to color space coordinates measured on the panel on which only the second pixels are turned on under the darkroom environment, the third sections may be defined such that color space coordinates measured on the panel on which only the third pixels are turned on under a third lighting environment corresponding to the third light amount data vary with respect to color space coordinates measured on the panel on which only the third pixels are turned on under the darkroom environment.

As the first light amount increases in the ambient light, a difference between the first reference gamma curve and the first controlled gamma curve may increase, as the second light amount increases in the ambient light, a difference between the second reference gamma curve and the second controlled gamma curve may increase, and as the third light amount increases in the ambient light, a difference between the third reference gamma curve and the third controlled gamma curve may increase.

As the first light amount increases in the ambient light, the first sections may increase, as the second light amount increases in the ambient light, the second sections may increase, and as the third light amount increases in the ambient light, the third sections may increase.

The ambient light sensor may include a first photo sensor, a second photo sensor, and a third photo sensor.

The display apparatus may further include a backlight configured to emit light from a back of the panel; an illumination calculator configured to receive the first light amount data, the second light amount data, and the third light amount data and to calculate an illumination level of the ambient light based on the first light amount data, the second light amount data, and the third light amount data; a comparison unit configured to compare the illumination level of the ambient light with a preset critical illumination level; and a backlight controller configured to control a luminescence of the backlight based on the illumination level of the ambient light if the illumination level of the ambient light is higher than the critical illumination level.

The first pixels, the second pixels, and the third pixels may correspond to red pixels, green pixels, and blue pixels, respectively.

According to aspects of one or more embodiments of the present invention, a display apparatus includes a liquid crystal panel including red pixels, green pixels, and blue pixels; a backlight configured to emit light from a back of the liquid crystal panel; an ambient light sensor configured to measure a red light amount, a green light amount, and a blue light amount in ambient light around the liquid crystal panel, the ambient light sensor configured to generate red light amount data corresponding to the red light amount, green light amount data corresponding to the green light amount, and blue light amount data corresponding to the blue light amount; an illumination calculator configured to receive the red light amount data, the green light amount data, and the blue light amount data to calculate an illumination level of the ambient light based on the red light amount data, the green light amount data, and the blue light amount data; a determining unit configured to compare the illumination level of the ambient light with a preset critical illumination level, the determining unit configured to determine a correction mode as one of a first correction mode and a second correction mode according to a comparison result; a backlight controller configured to control, in the first correction mode, a luminescence of the backlight based on the illumination level of the ambient light; a gamma controller configured to control, in the second correction mode, first sections of a first reference gamma curve based on the red light amount data to generate a first controlled gamma curve, the gamma controller configured to control second sections of a second reference gamma curve based on the green light amount data to generate a second controlled gamma curve, and the gamma controller configured to control third sections of a third reference gamma curve based on the blue light amount information to generate a third controlled gamma curve; a data driver configured to convert, in the second correction mode, a red image signal into a red data voltage based on the first controlled gamma curve, the data driver configured to supply the red data voltage to the red pixels, the data driver configured to convert a green image signal into a green data voltage based on the second controlled gamma curve, the data driver configured to supply the green data voltage to the green pixels, the data driver configured to convert a blue image signal into a blue data voltage based on the third controlled gamma curve, and the data driver configured to supply the blue data voltage to the blue pixels; and a gate driver configured to supply a gate signal to the red pixels, the green pixels, and the blue pixels.

In the first correction mode, the data driver may be configured to: convert a red image signal into a red data voltage based on the first reference gamma curve and to supply the red data voltage to the red pixels, convert a green image signal into a green data voltage based on the second reference gamma curve and to supply the green data voltage to the green pixels, and convert a blue image signal into a blue data voltage based on the third reference gamma curve and to supply the blue data voltage to the blue pixels.

BRIEF DESCRIPTION OF THE DRAWINGS

Aspects of embodiments of the present invention may be implemented by using a system, a method, a computer program, or a combination of the system, the method, and the computer program.

These and/or other aspects will become apparent and more readily appreciated from the following description of the embodiments, taken in conjunction with the accompanying drawings in which.

DETAILED DESCRIPTION

Figure 1:
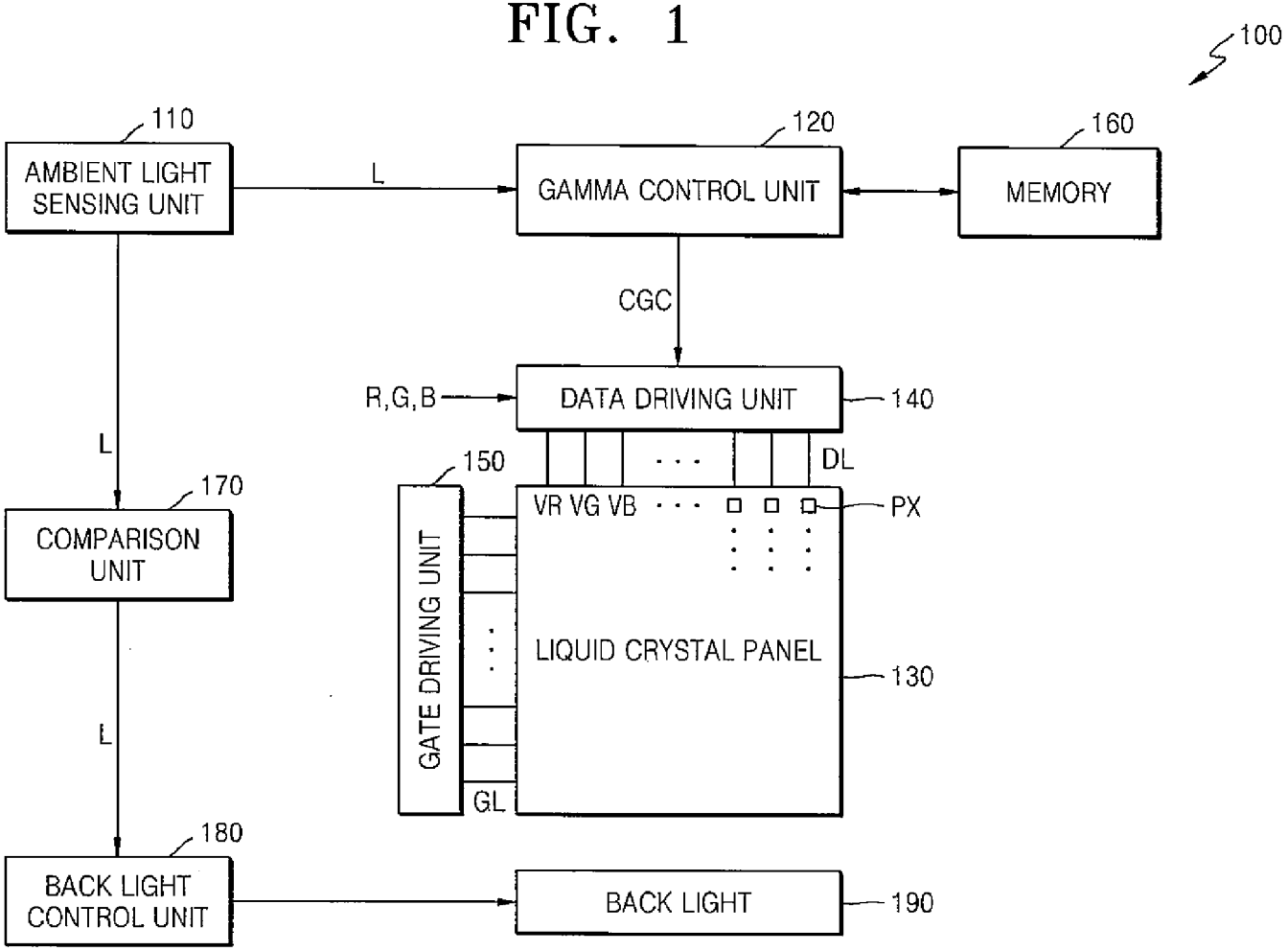
FIG. 1 is a schematic block diagram of a liquid crystal display apparatus according to one embodiment.

Particular embodiments of the present invention will be illustrated in the drawings and described in the detailed description in some detail. Some of the effects and features of the embodiments of the present invention and methods of achieving them will be apparent from these embodiments. However, the present invention may be embodied in different forms and should not be construed as being limited to the embodiments set forth herein.

Aspects of the embodiments of the present invention will be described in some detail with reference to the accompanying drawings. In the drawings, the same or corresponding components are denoted by the same reference numerals.

The terms "first" and "second" used herein are not intended to limit the scope of the present invention and are used only for distinguishing a component from another component. The singular form may include the plural form unless specifically described in the specification. The terms "comprise" and "has" mean that the features or components described in the specification are included in the respective embodiments and do not exclude the possibility of adding one or more new features or components. Expressions such as "at least one of," when preceding a list of elements, modify the entire list of elements and do not modify the individual elements of the list.

FIG. 1 is a schematic block diagram of a liquid crystal display apparatus according to one embodiment.

Referring to FIG. 1, a liquid crystal display apparatus 100 includes a liquid crystal panel 130, a data driving unit (or data driver) 140, a gate driving unit (or gate driver) 150, an ambient light sensing unit (or ambient light sensor) 110, and a gamma control unit (or gamma controller) 120. The liquid crystal panel 130 includes pixels PX that display images. The ambient light sensing unit 110 senses the illumination of light around the liquid crystal panel 130 and generates ambient light information L. The gamma control unit 120 controls, based on the ambient light information L, some sections of a reference gamma curve that defines an output according to an input, and generates a controlled gamma curve. The data driving unit 140 converts image signals R, G, and B into data voltages VR, VG, and VB based on the controlled gamma curve and supplies the data voltages VR, VG, and VB to the pixels PX. The gate driving unit 150 supplies gate signals to the pixels PX.

The liquid crystal panel 130 includes the liquid crystal layer between two glass substrates. The liquid crystal panel 130 includes a plurality of data lines DL and a plurality of gate lines GL that intersect with each other, and a plurality of pixels PX that are arranged in a matrix form. The pixels PX are coupled to the data lines DL and the gate lines GL. Each of the pixels PX may be referred to as a liquid crystal cell.

The data lines DL, the gate lines GL, thin film transistors, and storage capacitors are formed on the lower glass substrate of the liquid crystal panel 130. The pixels PX are coupled to the thin film transistors and driven by the electric field between pixel electrodes and a common electrode. A black matrix, a color filter, and a common electrode are formed on the upper glass substrate of the liquid crystal panel 130.

In a vertical electric field driving mode such as a twisted nematic (TN) mode and a vertical alignment mode, a common electrode is formed on the upper glass substrate. In a horizontal electric field driving mode such as an in a plane switching mode and a fringe field switching mode, a common electrode is formed on the lower glass substrate together with a pixel electrode. A polarizer is attached to each of the upper and the lower glass substrates of the liquid crystal panel 130 and an alignment film is formed thereon to facilitate the liquid crystal material in aligning at an angle (e.g., a pre-tilt angle).

Although not shown, the data driving unit 140 and the gate driving unit 150 are controlled by data control signals and gate control signals that are provided from a timing controller (not shown). The timing controller receives data enable signals, timing signals such as dot clock, etc., from an external system board (not shown). The timing controller generates data control signals for controlling the operation timing of the data driving unit 140 in response to the timing signal and gate control signals for controlling the operation timing of the gate driving unit 150. The gate control signals may include a gate start pulse, a gate shift clock signal, a gate output enable signal, etc. The data control signals may include a source start pulse, a source sampling clock signal, a source output enable signal, a polarity control signal, etc.

A gamma curve may be controlled by using two modes. One mode is a data modulation mode wherein image signals R, G, and B are modulated to generate a modulated image signal and then the modulated image signal is converted into data voltages VR, VG, and VB based on reference gamma voltages. The other mode is a reference gamma voltage modulation mode wherein reference gamma voltages are modulated without modulating image signals R, G, and B to generate modulated reference gamma voltages and then the image signals R, G, and B are converted into the data voltages VR, VG, and VB based on the modulated reference gamma voltages. The gamma control unit 120 controls the gamma curve to be able to apply both of the two modes above. The controlled gamma curve may be used for generating the modulated image signal based on the image signals R, G, and B and may be used for generating the modulated reference gamma voltages based on the reference gamma voltages.

The data modulation mode will be described below. The timing controller receives the image signals R, G, and B from an external system board. The timing controller provides the image signals R, G, and B to the gamma control unit 120, and the gamma control unit 120 uses the controlled gamma curve to generate the modulated image signal. The gamma control unit 120 provides the modulated image signal to the timing controller which realigns the modulated image signal according to the resolution of the liquid crystal panel 130 and supplies the signal to the data driving unit 140.

The data driving unit 140 converts the modulated image signal into the data voltages VR, VG, and VB based on the reference gamma voltages in response to a data control signal provided from the timing controller, and supplies the data voltages VR, VG, and VB to the data lines DL of the liquid crystal panel 130. The data driving unit 140 may include a plurality of data drive ICs that each include a shift register for sampling a clock signal, a register for temporarily storing a modulated image signal as modulated image data, a latch for outputting modulated image data line by line in response to a clock signal provided from the shift register, a digital/analog converter for selecting, among the reference gamma voltages, a positive/negative gamma voltage corresponding to a value of modulated image data provided from the latch, a multiplexer for selecting a data line DL to which the data voltages VR, VG, and VB converted by the selected positive/negative gamma voltage are supplied, and an output buffer coupled between the multiplexer and the data line DL and outputting the data voltages VR, VG, and VB to the data line DL.

The reference gamma voltage modulation mode will be described below. The timing controller receives the image signals R, G, and B from an external system board, re-aligns the image signals according to the resolution of the liquid crystal panel 130 and supplies the re-aligned signals to the data driving unit 140.

The gamma control unit 120 uses a controlled gamma curve to convert reference gamma voltages provided from a reference gamma voltage generating unit into modulated reference gamma voltages. The data driving unit 140 converts the image signals R, G, and B into the data voltages VR, VG, and VB based on the modulated reference gamma voltages provided from the gamma control unit 120 in response to a data control signal provided from the timing controller, and supplies the data voltages VR, VG, and VB to the data lines DL of the liquid crystal panel 130.

The gate driving unit 150 sequentially supplies to the gate lines GL a scan pulse that selects the horizontal line of the liquid crystal panel 130 to which the data voltages VR, VG, and VB will be supplied. The gate driving unit 150 may include a plurality of gate drive ICs, each of which may include a shift register, a level shifter for converting the output signal of the shift register so that it has a swing width to be able to drive the thin film transistor of a pixel PX, and an output buffer coupled between the level shifter ad the gate line GL and outputting a scan pulse to the gate lines GL.

The ambient light sensing unit 110 may include an illumination sensor that senses the illumination of outside or external ambient light around the liquid crystal panel 130 and generates ambient light information L. The illumination sensor may include a photodiode. According to another example, the ambient light sensing unit 110 may measure the amount of red light, the amount of green light, and the amount of blue light included in ambient light, and then may calculate the illumination of the ambient light based on the measured amount of red light, the measured amount of green light, and the measured amount of blue light. To this end, the ambient light sensing unit 110 may include three photodiodes that respond to red light, green light, and blue light, respectively. The ambient light sensing unit 110 provides the ambient light information L to the gamma control unit 120.

The gamma control unit 120 generates a controlled gamma curve that corresponds to the ambient light information L. The controlled gamma curve is generated by changing some sections of a reference gamma curve. The reference gamma curve is defined as a gamma curve to be used or established in the case of a darkroom environment. The some sections may be determined depending on the ambient light information L. In addition, the reference gamma curve and the controlled gamma curve are different in the some sections, and the difference between the reference gamma curve and the controlled gamma curve may be determined depending on the ambient light information L.

As described above, the gamma control unit 120 may use the controlled gamma curve to convert image signals R, G, and B into modulated image signals or convert reference gamma voltages into modulated reference gamma voltages.

The reference gamma curve and the controlled gamma curve may be understood as transfer functions that define an input and an output. The input may be the grayscale (e.g., gray level) values of the image signals R, G, and B. The output may be the voltage levels of data voltages VR, VB, and VB.

The gamma curve may be made in the form of a data set in the gamma control unit 120. The data set may include input data and output data based on the input data according to the gamma curve. The data set may include a mapping table of the input data and the output data.

As described above, the controlled gamma curve and the reference gamma curve are different in some sections and are the same in other sections. The sections for which the controlled gamma curve and the reference gamma curve are different may be defined by a certain range of the inputs and may correspond to the input between a first input value and a second input value. For example, if the first input value is I1 and the second input value is I2, the sections where the controlled gamma curve and the reference gamma curve are different may be defined as when the grayscale (e.g., gray level) values of the image signals R, G, and B are between the first input value I1 and the second input value I2.

If the grayscale (e.g., gray level) values of the image signals R, G, and B are included in the sections of the controlled gamma curve and the reference gamma curve that are different, output data according to the reference gamma curve is different from output data according to the controlled gamma curve. That is, data voltages VR, VB, and VB determined according to the reference gamma curve are different from data voltages VR, VG, and VB determined according to the controlled gamma curve. In contrast, if the grayscale (e.g., gray level) values of the image signals R, G, and B that are included in the sections of the controlled gamma curve and the reference gamma curve that are the same, output data according to the reference gamma curve is the same as output data according to the controlled gamma curve. That is, data voltages VR, VG, and VB determined according to the reference gamma curve are the same as data voltages VR, VG, and VB determined according to the controlled gamma curve.

The controlled gamma curve that is generated by controlling some sections of the reference gamma curve will be described below in some detail with reference to FIGS. 2 and 3. On the other hand, the gamma control unit 120 may also be applied to a liquid crystal display apparatus in which an YCbCr color space instead of an RGB color space is used, as it is. However, only an example of using the RGB color space will be described below for convenience of description.

According to one embodiment, the liquid crystal display apparatus 100 may further include a memory 160 that stores a plurality of controlled gamma curves defined according to the illumination of ambient light. That is, the memory 160 may store information on the reference gamma curve which will be applied in a darkroom environment where the illumination of ambient light is 0 nit, and a plurality of controlled gamma curves which will be respectively applied in environments where the illumination of ambient light has a value (e.g., a predetermined value). For example, the memory 160 may store information on controlled gamma curves which will be applied in each of environments where the illumination of ambient light is 10 nit, 20 nit, 30 nit, . . . , 100 nit, 200 nit, 300 nit, . . . , 1000 nit, 2000 nit, 3000 nit. Information on the controlled gamma curve may be in the form of a data set in which an input and an output are defined. Information on the plurality of controlled gamma curves that is stored in the memory 160 may be made by performing tests several times. The gamma control unit 120 may read from the memory 160 a controlled gamma curve that corresponds to ambient light information L provided from the ambient light sensing unit 110.

According to an embodiment, the liquid crystal display apparatus 100 may further include a backlight 190 radiating light from the back surface of the liquid crystal panel 130, a comparison unit 170 receiving ambient light information L and comparing the illumination of the ambient light with preset critical illumination, and a backlight control unit controlling the luminescence of the backlight 190 based on the ambient light information L if the illumination of the ambient light is higher than the critical illumination.

The backlight 190 may include a light source that is at least one of a cold cathode fluorescent lamp (CCFL), an external electrode fluorescent lamp (EEFL), or an LED. The backlight 190 may be controlled by a backlight driving unit. The backlight driving unit uses an operating power source input from an external system board to generate a backlight control signal that matches a dimming signal. The backlight driving unit may be an inverter or LED drive depending on the type of a light source.

The preset critical illumination may be an illumination value to identify an indoor environment and an outdoor environment. For example, the preset critical illumination may be any value between 1000 nit and 10000 nit. For example, the preset critical illumination may be 5000 nit. In an environment having strong illumination such as an outdoor environment, the visibility of an image displayed on the liquid crystal display apparatus 100 may be improved by raising the luminescence of the backlight 190.

Figure 2:
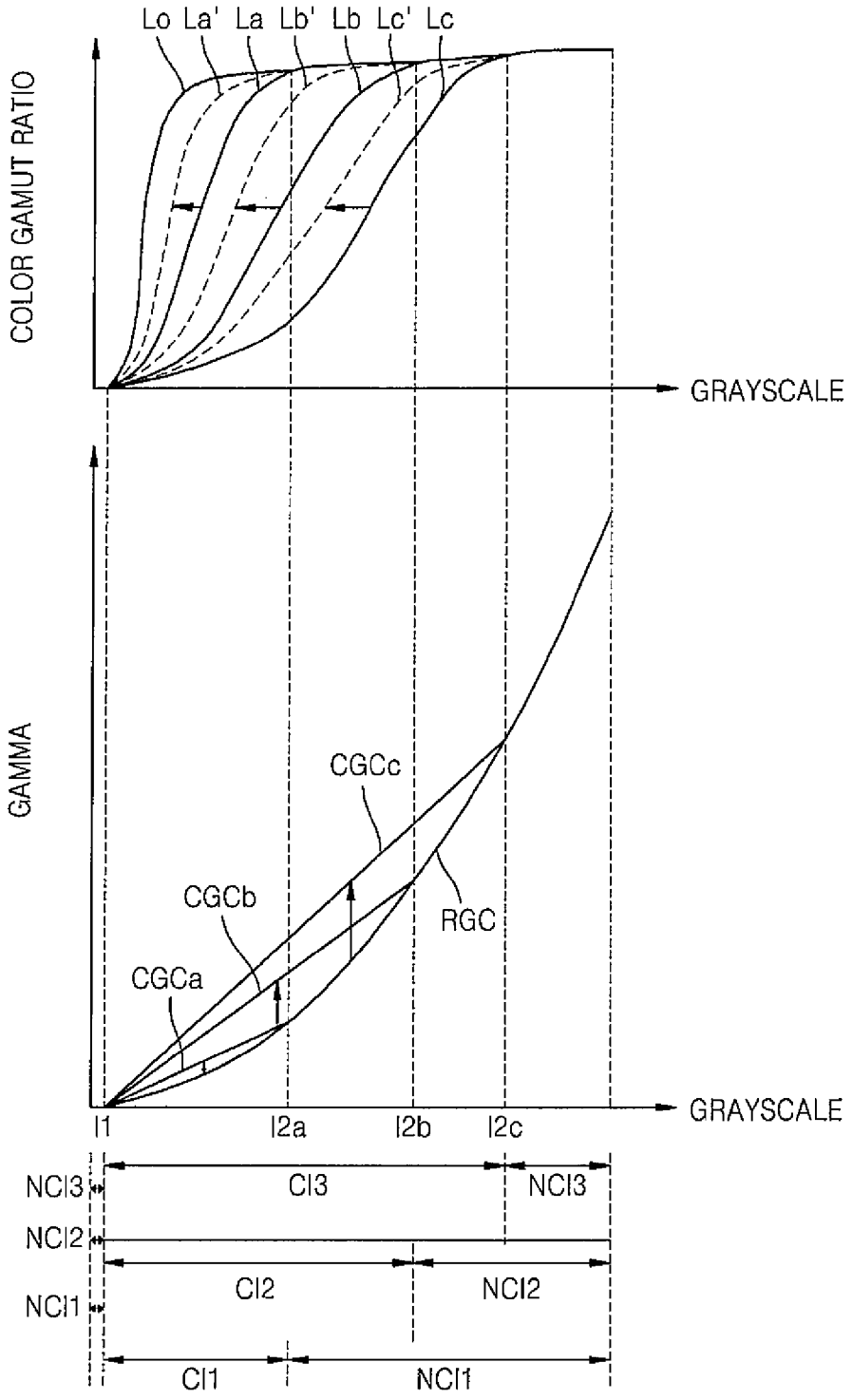
FIG. 2 shows example graphs representing a color gamut ratio vs. a grayscale (e.g., gray level) input and gamma vs. a grayscale (e.g., gray level) input according to one embodiment.

FIG. 2 shows example graphs representing a color gamut ratio vs. a grayscale (e.g., gray level) input and gamma vs. a grayscale (e.g., gray level) input according to one embodiment.

Referring to FIG. 2, two graphs are shown. The upper graph shows color gamut ratios La, La, Lb, and Lc vs. grayscale (e.g., gray level) inputs that depend on the illumination of ambient light. The lower graph shows a reference gamma curve RGC and controlled gamma curves CGCa, CGCb, and CGCc that depend on the illumination of ambient light.

The color gamut ratio means a numeric ratio showing how well original colors are reproduced. Ideally, a color gamut ratio vs. a grayscale (e.g., gray level) input may be 1 (i.e., 100%) except when the grayscale (e.g., gray level) input is 0. Actually, as the grayscale (e.g., gray level) input is close to maximum (e.g., close to 255 in the case of 8 bits), the color gamut ratio is approximately 1. However, as the grayscale (e.g., gray level) input is close to 0, the color gamut ratio decreases as shown on the upper graph of FIG. 2. The reason for the color gamut decreasing as the grayscale (e.g., gray level) input is close to 0 is because the luminescence of light emitted from the liquid crystal display apparatus is not as high when the grayscale (e.g., gray level) input is relatively lower, and therefore the influence of internal factors such as light leakage from the inside of the liquid crystal display apparatus and external factors such as the reflection of external light is relatively higher. As a result, the color gamut ratio decreases. If the grayscale (e.g., gray level) input becomes minimum (e.g., 0), light is not emitted to the outside, and thus, the color gamut ratio becomes 0. The color gamut ratio is affected by external conditions, however, such as the illumination of external or ambient light. In addition, the color gamut ratio also varies depending on the design of the liquid crystal display apparatus, the material of a liquid crystal layer, a display mode, etc.

On the upper graph, the curve Lo represents a color gamut ratio to grayscale (e.g., gray level) inputs in a darkroom environment. The curves La, Lb, and Lc represent color gamut ratios to grayscale (e.g., gray level) inputs in an environment where there is ambient light. The curve La is a color gamut ratio graph when the ambient light has a first illumination, the curve Lb is a color gamut ratio graph when the ambient light has a second illumination, and the curve Lc is a color gamut ratio graph when the ambient light has a third illumination. The first illumination is lower than the second illumination and the third illumination is higher than the second illumination. That is, as the illumination of the ambient light becomes higher, the color gamut ratio decreases, because the ambient light is reflected from the screen of the liquid crystal display apparatus. If the grayscale (e.g., gray level) input is high, the luminescence of light emitted from the screen of the liquid crystal display apparatus is high and thus an impact on the ambient light relatively decreases. Accordingly, both a darkroom environment and an environment having ambient light have substantially the same color gamut ratio.

As shown in FIG. 2, as the illumination of ambient light increases, the color gamut ratio graph moves to the right. In an environment where the ambient light has a first illumination, if a grayscale (e.g., gray level) input is large, the color gamut ratio graph Lo in a darkroom and a first color gamut ratio graph La in an environment where the ambient light has the first illumination are the same or slightly different but if the grayscale (e.g., gray level) input becomes smaller than a second input value I2*a*, the first color gamut ratio graph La becomes lower than the color gamut ratio graph Lo in the darkroom. If the grayscale (e.g., gray level) input is equal to or smaller than an first input value I1 close to 0, the first color gamut ratio graph La and the color gamut ratio graph Lo in the darkroom are the same or slightly different. The slight difference may be selected from about 0.1% to 5% color gamut ratios, for example. Also, the slight difference may be selected from about 0.5% to 3% color gamut ratios, for example. In addition, the slight difference may be selected from about 1% to 2% color gamut ratios, for example.

In an environment where the ambient light has the second illumination, if the grayscale (e.g., gray level) input data is smaller than a third input value I2*b* that is larger than the second input value I2*a*, a second color gamut ratio graph Lb in the environment where the ambient light has the second illumination becomes lower than the color gamut ratio graph Lo in the darkroom. If the value of the grayscale (e.g., gray level) input data is equal to or smaller than the first input value I1 close to 0, the second color gamut ratio graph Lb and the color gamut ratio graph Lo in the darkroom are the same or slightly different.

In an environment where the ambient light has the third illumination, if the value of the grayscale (e.g., gray level) input data is smaller than a fourth input value I2*c* that is larger than the third input value I2*b*, a third color gamut ratio graph Lc in the environment where the ambient light has the third illumination becomes lower than the color gamut ratio graph Lo in the darkroom. If the value of the grayscale (e.g., gray level) input data is equal to or smaller than the first input value I1 close to 0, the third color gamut ratio graph Lb and the color gamut ratio graph Lo in the darkroom are the same or slightly different.

Referring to the lower graph of FIG. 2, a gamma curve to be applied to the liquid crystal display apparatus in the darkroom may be the reference gamma curve RGC, but a gamma curve to be applied to the liquid crystal display apparatus in the environment where ambient light has the first illumination may be a first controlled gamma curve CGCa, a gamma curve to be applied to the liquid crystal display apparatus in the environment where ambient light has the second illumination may be a second controlled gamma curve CGCb, and a gamma curve to be applied to the liquid crystal display apparatus in the environment where ambient light has the third illumination may be a third controlled gamma curve CGCc. On the lower graph of FIG. 2, the outputs of gamma curves are indicated by the axis Gamma. As described above, the gamma may mean the voltage levels of data voltages VR, VG, and VB. That is, the lower graph of FIG. 2 may represent the voltage levels of the data voltages VR, VG, and VB to the grayscale (e.g., gray level) values of image signals R, G, and B.

The first controlled gamma curve CGCa is different from the reference gamma curve RGC in a first control section CI1 that is from the first input value I1 to the second input value I2*a*, and is the same as the reference gamma curve RGC in a first non-control section NCI1 that excludes the first control section CI1 from the entire sections. The second controlled gamma curve CGCb is different from the reference gamma curve RGC in a second control section CI2 that is from the first input value I1 to the third input value I2*b*, and is the same as the reference gamma curve RGC in a second non-control section NCI2. The third controlled gamma curve CGCb is different from the reference gamma curve RGC in a third control section CI3 that is from the first input value I1 to the fourth input value I2*c*, and is the same as the reference gamma curve RGC in a third non-control section NCI3.

Both an input value having a minimum grayscale (e.g., gray level) value and an input value having a maximum grayscale (e.g., gray level) value are included in the first to the third non-control sections NCI1 to NCI3. That is, for the input value having the minimum grayscale (e.g., gray level) value and the input value having the maximum grayscale (e.g., gray level) value, the outputs of the first to the third controlled gamma curves CGCa through CGCc are the same as the output of the reference gamma curve RGC. That is, the controlled gamma curves CGCa, CGCb, CGCc are obtained by modifying some sections of the reference gamma curve RGC, not the entire sections of the reference gamma curve RGC.

The width of the first control section CI1 of the first controlled gamma curve CGCa to be applied to the liquid crystal display apparatus in the environment having the first illumination that is lowest is narrowest and a variable width of the first controlled section CI1 is also smallest. The variable of the third control section CI3 of the third controlled gamma curve CGCc to be applied to the liquid crystal display apparatus in the environment having the third illumination that is highest is narrowest and the variable width of the third controlled section CI3 is also largest. Thus, the difference between the first controlled gamma curve CGCa and the reference gamma curve RGC is smallest and the difference between the third controlled gamma curve CGCc and the reference gamma curve RGC is greatest. That is, for the value of the grayscale (e.g., gray level) input data in the first control section CI1 in the environment having the first illumination that is lowest, the luminescence of the liquid crystal display apparatus slightly increases, and for the value of the grayscale (e.g., gray level) input data in the third control section CI3 in the environment having the third illumination that is highest, the luminescence of the liquid crystal display apparatus significantly increases.

Although the lower limits of the first to the third control sections CI1 to CI3 are all illustrated by the first input value I1, they may be different from one another. The lower limits (e.g., the first input value I1) of the first to the third control sections CI1 to CI3 may remain constant or may increase as illumination becomes higher. In addition, as shown in the graphs of FIG. 2, the upper limits of the first to the third control sections CI1 to CI3 may remain constant or may increase as illumination becomes higher.

The first controlled gamma curve CGCa in the first control section CI1, the second controlled gamma curve CGCb in the second control section CI2, and the third controlled gamma curve CGCc in the third control section CI3 are exemplarily shown to have certain slopes. However, the first controlled gamma curve CGCa in the first control section CI1, the second controlled gamma curve CGCb in the second control section CI2, and the third controlled gamma curve CGCc in the third control section CI3 may have different forms.

As a gamma curve to be applied to the liquid crystal display apparatus is changed to the first to the third controlled gamma curves CGCa, CGCb, CGCc according to the illumination of ambient light as shown on the lower graph of FIG. 2, a color gamut ratio is improved as shown on the upper graph of FIG. 2. The first color gamut ratio graph La is improved as in a first improved color gamut ratio graph La'. The second color gamut ratio graph Lb is improved as in a second improved color gamut ratio graph Lb'. The third color gamut ratio graph Lc is improved as in a first improved color gamut ratio graph Lc'.

Thus, because the liquid crystal display apparatus according to one embodiment controls the luminescence of the liquid crystal display apparatus according to illumination of ambient light, its visibility may be improved.

In addition, by determining a section controlling a gamma curve according to a color gamut ratio graph, it is possible to improve a color gamut ratio without distorting or significantly distorting image quality and thus express a color similar to an original color. For example, if a gamma curve is also modified in a non-control section, a distortion caused by the modification of the gamma curve becomes more serious than a distortion caused by ambient light.

Figure 3:
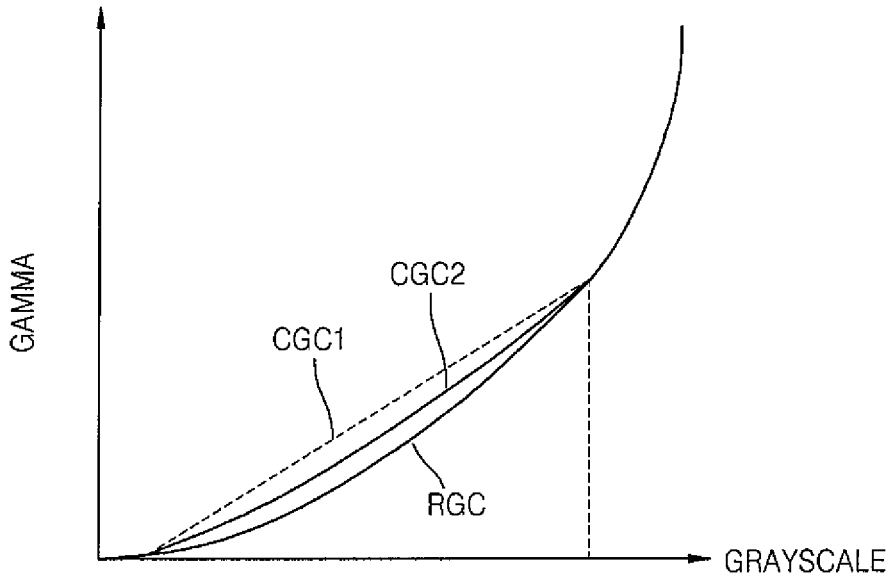
FIG. 3 shows controlled gamma curves according to one embodiment.

FIG. 3 shows controlled gamma curves according to one embodiment.

Referring to FIG. 3, a reference gamma curve RGC, and first and second controlled gamma curves CGC1 and CGC2 are shown.

The reference gamma curve RGC represents the voltage levels of data voltages VR, VG, and VB for the grayscale (e.g., gray level) values of image signals R, G, and B to be applied to the liquid crystal display apparatus in a darkroom environment.

The first and the second controlled gamma curves CGC1 and CGC2 represent the voltage levels of data voltages VR, VG, and VB for the grayscale (e.g., gray level) values of image signals R, G, and B to be applied to the liquid crystal display apparatus in an ambient light environment having certain illumination.

As shown in FIG. 3, the first and the second controlled gamma curves CGC1 and CGC2 are different from the reference gamma curve RGC only in some sections. As shown in FIG. 3, the first controlled gamma curve CGC1 may have a constant slope in the some sections. As shown in FIG. 3, the second controlled gamma curve CGC2 may be a continuous curve between the first controlled gamma curve CGC1 and the reference gamma curve RGC in the some sections. For example, the slope at the lower limit of the some sections of the second controlled gamma curve CGC2 may be steeper than the slope at the lower limit of the some sections of the reference gamma curve RGC, and the slope at the upper limit of the some sections of the second controlled gamma curve CGC2 may be more gentle than the slope at the lower limit of the some sections of the reference gamma curve RGC. The second controlled gamma curve CGC2 may have a slope that continuously increases in the some sections.

Figure 4:
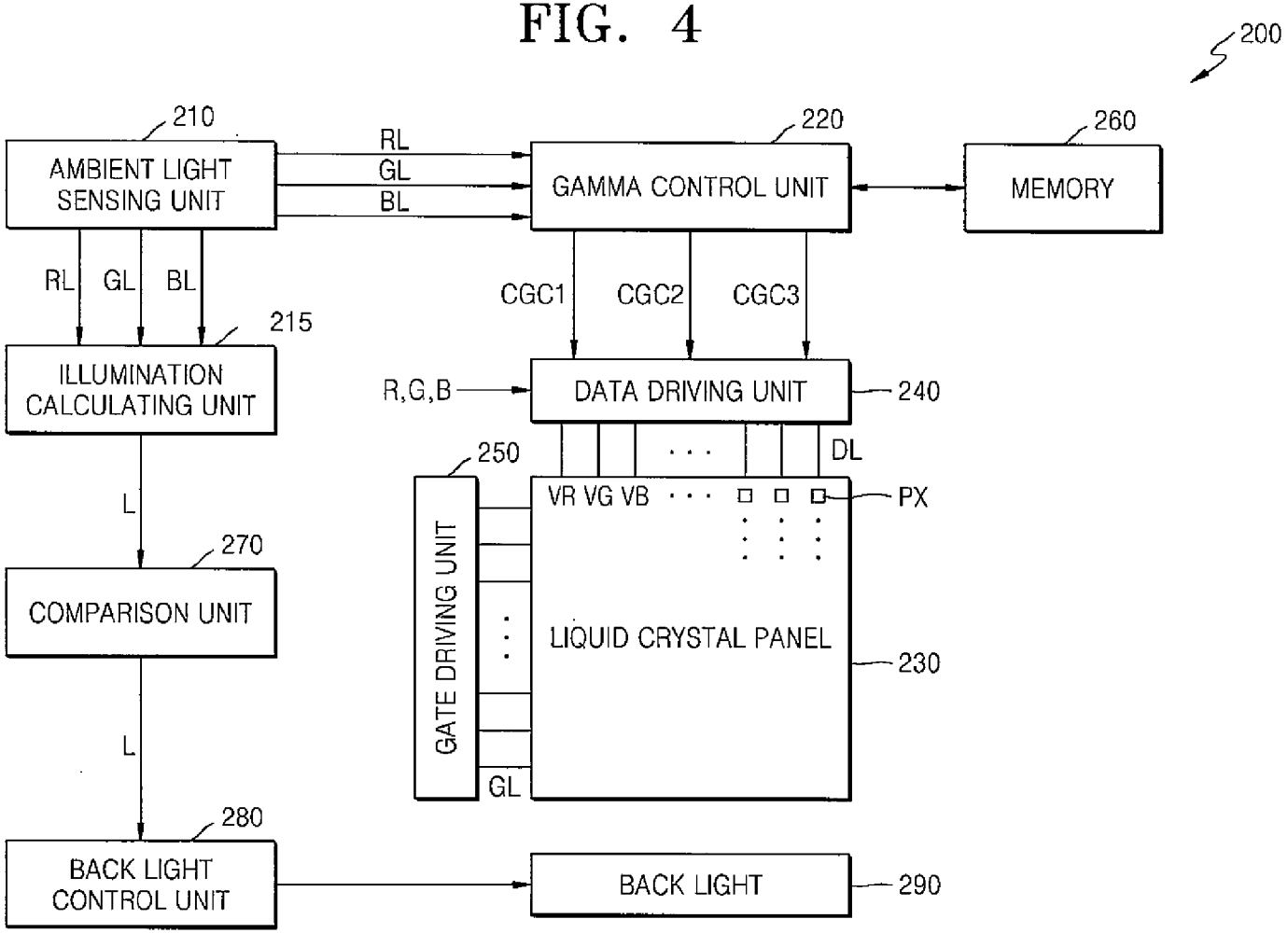
FIG. 4 is a schematic block diagram of a liquid crystal display apparatus according to another embodiment.

FIG. 4 is a schematic block diagram of a liquid crystal display apparatus according to another embodiment.

Referring to FIG. 4, a liquid crystal display apparatus 200 includes a liquid crystal panel 230, a data driving unit (or data driver) 240, a gate driving unit (or gate driver) 250, an ambient light sensing unit (or ambient light sensor) 210, and a gamma control unit (or gamma controller) 220. The crystal panel 230, the data driving unit 240, and the gate driving unit 250 are respectively substantially the same as the crystal panel 130, the data driving unit 140, and the gate driving unit 150, and thus, are not repetitively described.

The liquid crystal panel 230 includes red pixels, green pixels, and blue pixels. The ambient light sensing unit 210 measures the amount of red light, the amount of green light, and the amount of blue light in ambient light around or external with respect to the liquid crystal panel 230, and generates red light amount information RL corresponding to the amount of red light, green light amount information GL corresponding to the amount of green light, and blue light amount information BL corresponding to the amount of blue light. The gamma control unit 220 controls first some sections of a first reference gamma curve based on the red light amount information RL to generate a first controlled gamma curve CGC1, controls second some sections of a second reference gamma curve based on the green light amount information RL to generate a second controlled gamma curve CGC2, and controls third some sections of a third reference gamma curve based on the blue light amount information RL to generate a third controlled gamma curve CGC3. The data driving unit 240 converts a red image signal R into a red data voltage VR based on the first controlled gamma curve CGC1, supplies the red data voltage VR to the red pixels, converts a green image signal G into a green data voltage VG based on the second controlled gamma curve CGC2, supplies the green data voltage VG to the green pixels, and converts a blue image signal B into a blue data voltage VB based on the third controlled gamma curve CGC3, and supplies the blue data voltage VB to the blue pixels. The gate driving unit 250 supplies gate signals to the red pixels, the green pixels, and the blue pixels.

In the liquid crystal display apparatus 200, a first gamma used for converting the red image signal R into the red data voltage VR, a second gamma curve used for converting the green image signal G into the green data voltage VG, and a third gamma curve used for converting the blue image signal B into the blue data voltage VB may be different from one another. The transmittance of light may vary depending on the color of a color filter of the liquid crystal display apparatus 200, and in order to correct it, different gamma curves may be used for each color.

The ambient light sensing unit 210 may include a red photo sensor, a green photo sensor, and a blue photo sensor for measuring the amount of red light, the amount of green light, and the amount of blue light that are included in ambient light. The ambient light sensing unit 210 may include an analog-digital converter for generating the red light amount information RL corresponding to the amount of red light, the green light amount information GL corresponding to the amount of green light, and the blue light amount information BL corresponding to the amount of blue light. The red photo sensor, the green photo sensor, and the blue photo sensor may respectively measure the amount of red light, the amount of green light, and the amount of blue light in the ambient light, and may respectively generate the red light amount information RL, the green light amount information GL, and the blue light amount information BL, respectively.

The gamma control unit 220 may receive the red light amount information RL, the green light amount information GL, and the blue light amount information BL from the ambient light sensing unit 210. The gamma control unit 220 may generate the first controlled gamma curve CGC1 based on the red light amount information RL, generate the second controlled gamma curve CGC2 based on the green light amount information GL, and generate the third controlled gamma curve CGC3 based on the blue light amount information BL. The first to the third controlled gamma curves CGC1 to CGC3 may be used in both a data modulation mode and a reference gamma voltage modulation mode.

The first controlled gamma curve CGC1 may be different only in first some sections from the first reference gamma curve used for converting the red image signal R into the red data voltage VR in a darkroom environment. The first some sections are determined according to the red light amount information RL. The first some sections may be determined so that color space coordinates measured on the liquid crystal panel 230 on which only the red pixels are turned on under a red lighting environment corresponding to the red light amount information RL are different by certain values from color space coordinates measured on the liquid crystal panel 230 on which only the red pixels are turned on in a darkroom environment.

The second controlled gamma curve CGC2 may be different only in second some sections from the second reference gamma curve used for converting the green image signal G into the green data voltage VG in the darkroom environment. The second some sections are determined according to the green light amount information GL. The second some sections may be determined so that color space coordinates measured on the liquid crystal panel 230 on which only the green pixels are turned on under a green lighting environment corresponding to the green light amount information GL are different by certain values from color space coordinates measured on the liquid crystal panel 230 on which only the green pixels are turned on in the darkroom environment.

The third controlled gamma curve CGC3 may be different only in third some sections from the third reference gamma curve used for converting the blue image signal B into the blue data voltage VB in the darkroom environment. The third some sections are determined according to the blue light amount information BL. The third some sections may be determined so that color space coordinates measured on the liquid crystal panel 230 on which only the blue pixels are turned on under a blue lighting environment corresponding to the blue light amount information BL are different by certain values from color space coordinates measured on the liquid crystal panel 230 on which only the blue pixels are turned on in the darkroom environment.

The relation between the first to the third some sections and the color space coordinates will be described below in some detail with reference to FIG. 5.

The first controlled gamma curve CGC1 is used for converting the red image signal R into the red data voltage VR, and the data driving unit 240 supplies the red data voltage VR to the red pixels of the liquid crystal panel 230. The second controlled gamma curve CGC2 is used for converting the green image signal G into the green data voltage VG, and the data driving unit 240 supplies the green data voltage VG to the green pixels of the liquid crystal panel 230. The third controlled gamma curve CGC3 is used for converting the blue image signal B into the blue data voltage VB, and the data driving unit 240 supplies the blue data voltage VB to the blue pixels of the liquid crystal panel 230.

According to one embodiment, the liquid crystal display apparatus 200 may further include a backlight 290 configured to emit light from the back surface of the liquid crystal panel 230, an illumination calculating unit 215 that receives the red light amount information RL, the green light amount information GL, and the blue light amount information BL and calculate the illumination L of the ambient light based on the red light amount information RL, the green light amount information GL, and the blue light amount information BL. The liquid crystal display apparatus 200 may further include a comparison unit 270 configured to compare the illumination L of the ambient light with present critical luminescence, and a backlight control unit 280 configured to control the luminescence of the backlight 290 based on the illumination L of the ambient light if the illumination L of the ambient light is larger than the critical illumination. The backlight 290, the backlight control unit 280, and the comparison unit 270 are respectively substantially the same as the backlight 190, the backlight control unit 180, and the comparison unit 170 described with reference to FIG. 1, and thus, repetitive descriptions thereof are omitted.

The illumination calculating unit 215 may calculate the illumination L of the ambient light based on the red light amount information RL, the green light amount information GL, and the blue light amount information BL. The illumination calculating unit 215 may make ambient light information corresponding to the illumination L of the ambient light. The ambient light information may correspond to the ambient light information L made by the ambient light sensing unit 110 described with reference to FIG. 1.

According to one embodiment, the liquid crystal display apparatus 200 may further include a memory 260. The memory 260 corresponds to the memory 160 previously described with reference to FIG. 1 and thus repetitive description thereof is omitted. The memory 260 may store a plurality of first controlled gamma curves that is defined according to red light amounts, a plurality of second controlled gamma curves that is defined according to green light amounts, and a plurality of third controlled gamma curves that is defined according to blue light amounts.

Specifically, when, e.g., the red light amount is indicated by an 8-bit grayscale (e.g., gray level) value, the memory 260 may store all the first controlled gamma curves to be applied to the liquid crystal display apparatus 200 when the red light amount is any one of 0 to 255. For example, the memory 260 may store a first controlled gamma curve when the red light amount is 0, a first controlled gamma curve when the red light amount is 10, a first controlled gamma curve when the red light amount is 20, a first controlled gamma curve when the red light amount is 100, a first controlled gamma curve when the red light amount is 150, a first controlled gamma curve when the red light amount is 200, a first controlled gamma curve when the red light amount is 250, a first controlled gamma curve when the red light amount is 255, etc.

The memory 260 may store all the second controlled gamma curves to be applied to the liquid crystal display apparatus 200 when the green light amount is any one of 0 to 255. The memory 260 may store all the third controlled gamma curves to be applied to the liquid crystal display apparatus 200 when the blue light amount is any one of 0 to 255.

The gamma control unit 220 may receive from the ambient light sensing unit 210 the red light amount information RL, the green light amount information GL, and the blue light amount information BL respectively corresponding to the red light amount, the green light amount, and the blue light amount that are included in the ambient light, read from the memory 260 the first controlled gamma curve CGC1 corresponding to the red light amount information RL, read from the memory 260 the second controlled gamma curve CGC2 corresponding to the green light amount information GL, and read from the memory 260 the third controlled gamma curve (CGC3) corresponding to the blue light amount information BL.

Figure 5A:
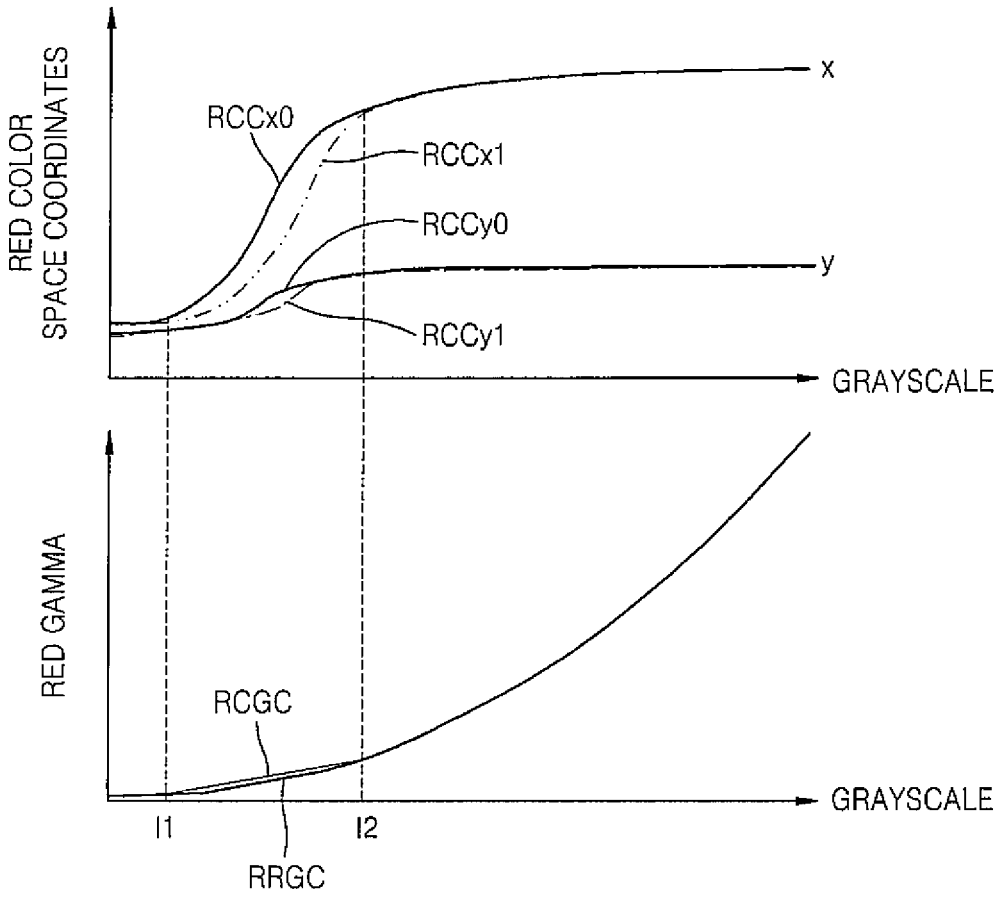
FIGS. 5A to 5C show example graphs representing red, green and blue color space coordinates vs. grayscale (e.g., gray level) inputs and gammas vs. grayscale (e.g., gray level) inputs according to another embodiment.
Figure 5B:
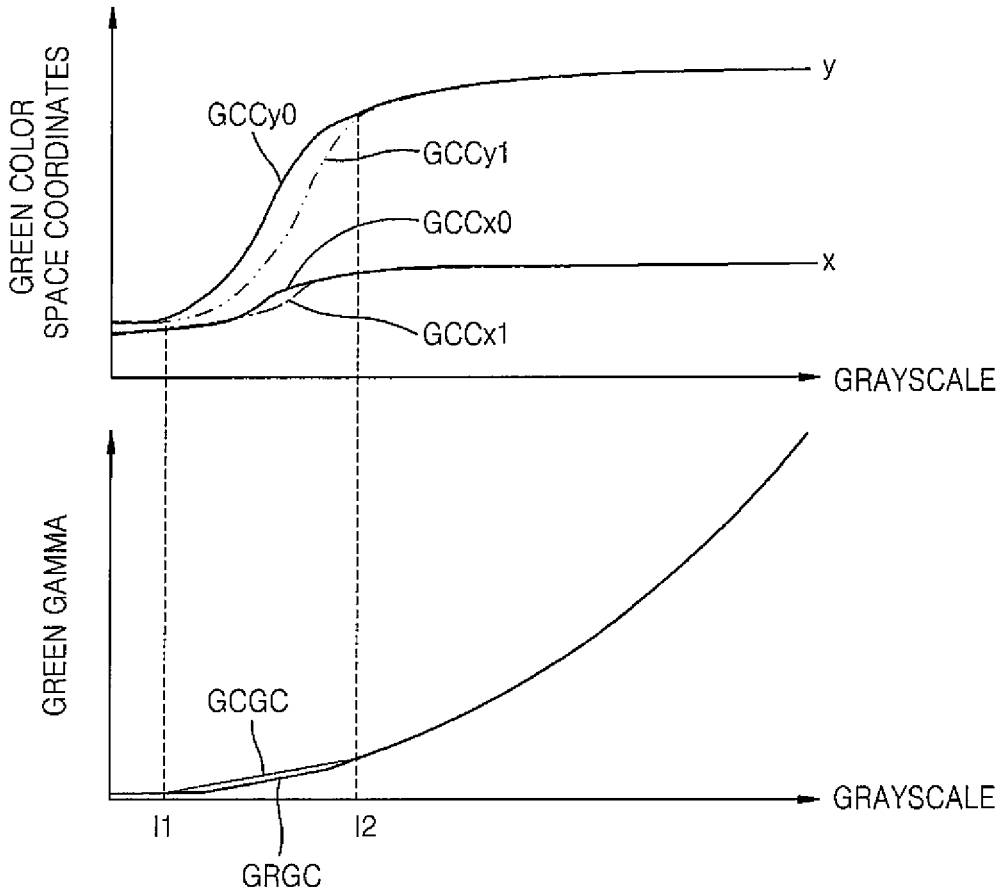
Figure 5C:
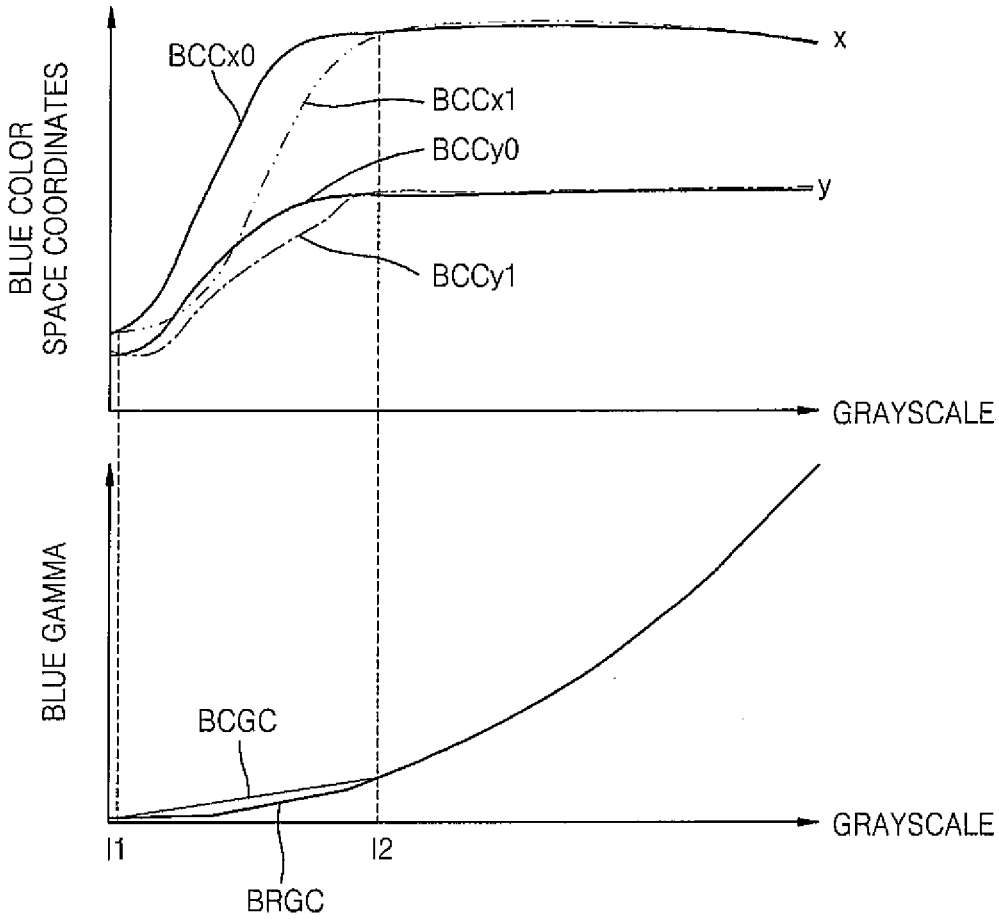

FIGS. 5A to 5C show example graphs representing red, green, and blue color space coordinates vs. grayscale (e.g., gray level) input data and gammas vs. grayscale (e.g., gray level) input data according to another embodiment.

In FIG. 5A, the upper part shows the x coordinate graph RCCx0 and the y coordinate graph RCCy0 of a color space coordinate for a red light which the liquid crystal display apparatus emits with respect to the value of the grayscale (e.g., gray level) input data of the red image signal R in a darkroom environment. The upper part shows the x coordinate graph RCCx1 and the y coordinate graph RCCy1 of a color space coordinate for a red light which the liquid crystal display apparatus emits with respect to the value of the grayscale (e.g., gray level) input data of the red image signal R in a red lighting environment.

Like the color gamut ratio graph shown in FIG. 2, some sections of the color space coordinate graph of FIG. 5A are different in a darkroom environment and a color lighting environment. As shown in FIG. 5A, in sections where the grayscale (e.g., gray level) value of the red image signal R is from a first input value I1 to a second input value I2, the color space coordinate graphs RCCx1 and RCCy1 in a red lighting environment are different from the color space coordinate graphs RCCx0 and RCCy0 in the darkroom environment.

The lower limit of the some sections may be defined as the first input value I1 and the upper limit of the some sections may be defined as the second input value I2.

On the lower graph of FIG. 5A, a red gamma vs. the value of the grayscale (e.g., gray level) input data of the red image signal R in a darkroom environment, namely, the level of a red data level VR, is shown as a first reference gamma curve RRGC. On the lower graph, a red gamma vs. the grayscale (e.g., gray level) input data of the red image signal R to be applied to the liquid crystal display apparatus in a red lighting environment, namely, the level of the red data level VR, is shown as a first controlled gamma curve RCGC. As shown in FIG. 5A, the first controlled gamma curve RCGC is different only in the some sections from the first reference gamma curve RRGC.

Like the color gamut ratio graph shown in FIG. 2, as red lighting becomes stronger, the width of the some sections widens. In addition, as the red lighting becomes stronger, the difference between the first controlled gamma curve RCGC and the first reference gamma curve RRGC becomes larger. Thus, as red lighting becomes stronger, the red pixels of the liquid crystal display apparatus 200 emit a stronger red light and the red color of the liquid crystal display apparatus 200 is highlighted. Thus, a decrease in visibility due to a phenomenon where the human eyes become less sensitive to a red color under red lighting may be reduced.

In FIG. 5B, the upper part shows the x coordinate graph GCCx0 and the y coordinate graph GCCy0 of a color space coordinate for a green light which the liquid crystal display apparatus emits with respect to the grayscale (e.g., gray level) input data of the green image signal G in the darkroom environment. The upper part shows the x coordinate graph GCCx1 and the y coordinate graph GCCy1 of a color space coordinate for the green light which the liquid crystal display apparatus emits with respect to the grayscale (e.g., gray level) input data of the green image signal G in a green lighting environment.

Like the color gamut ratio graph shown in FIG. 2, some sections of the color space coordinate graph of FIG. 5B are different in a darkroom environment and a lighting environment. As shown in FIG. 5B, in sections where the grayscale (e.g., gray level) value of the green image signal G is from the first input value I1 to the second input value I2, the color space coordinate graphs GCCx1 and GCCy1 in the green lighting environment are different from the color space coordinate graphs GCCx0 and GCCy0 in the darkroom environment. The lower limit of the some sections may be defined as the first input value I1 and the upper limit of the some sections may be defined as the second input value I2.

On the lower graph of FIG. 5B, a green gamma to the value of the grayscale (e.g., gray level) input data of the green image signal G in the darkroom environment, namely, the level of a green data level VG, is shown as a second reference gamma curve GRGC. On the lower graph, a green gamma to the grayscale (e.g., gray level) input of the green image signal G to be applied to the liquid crystal display apparatus in the green lighting environment, namely, the level of the green data level VG, is shown as a second controlled gamma curve GCGC. As shown in FIG. 5B, the second controlled gamma curve GCGC is different from the second reference gamma curve GRGC only in the some sections that are defined by the first input level I1 and the second input I2.

Like the color gamut ratio graph shown in FIG. 2, as green lighting becomes stronger, the width of the some sections widens. In addition, as the green lighting becomes stronger, the difference between the second controlled gamma curve GCGC and the second reference gamma curve GRGC becomes larger. Thus, as green lighting becomes stronger, the green pixels of the liquid crystal display apparatus 200 emit a stronger green light and the green color of the liquid crystal display apparatus 200 is highlighted. Thus, a decrease in visibility due to a phenomenon where the human eyes become less sensitive to a green color under green lighting may be reduced.

On the lower graph of FIG. 5A, a red gamma to the value of the grayscale (e.g., gray level) input data of the red image signal R in a darkroom environment, namely, the level of a red data level VR, is shown as a first reference gamma curve RRGC. On the lower graph, a red gamma to the grayscale (e.g., gray level) input of the red image signal R to be applied to the liquid crystal display apparatus in a red lighting environment, namely, the level of the red data level VR, is shown as a first controlled gamma curve RCGC. As shown in FIG. 5A, the first controlled gamma curve RCGC is different only in the some sections from the first reference gamma curve RRGC.

Like the color gamut ratio graph shown in FIG. 2, as red lighting becomes stronger, the width of the some sections widens. In addition, as the red lighting becomes stronger, the difference between the first controlled gamma curve RCGC and the first reference gamma curve RRGC becomes larger. Thus, as red lighting becomes stronger, the red pixels of the liquid crystal display apparatus 200 emit a stronger red light and the red color of the liquid crystal display apparatus 200 is emphasized. Thus, a decrease in visibility due to a phenomenon where the human eyes become less sensitive to a red color under red lighting may be reduced.

In FIG. 5C, the upper part shows the x coordinate graph BCCx0 and the y coordinate graph BCCy0 of a color space coordinate for a blue light which the liquid crystal display apparatus emits with respect to the grayscale (e.g., gray level) input of the blue image signal B in the darkroom environment. The upper part shows the x coordinate graph BCCx1 and the y coordinate graph BCCy1 of a color space coordinate for the blue light which the liquid crystal display apparatus emits with respect to the grayscale (e.g., gray level) input of the blue image signal B in a blue lighting environment.

Like the color gamut ratio graph shown in FIG. 2, some sections of the color space coordinate graph of FIG. 5C are different in the darkroom environment and the blue lighting environment. As shown in FIG. 5C, in sections where the grayscale (e.g., gray level) value of the blue image signal B is from the first input value I1 to the second input value I2, the color space coordinate graphs BCCx1 and BCCy1 in the blue lighting environment are different from the color space coordinate graphs BCCx0 and BCCy0 in the darkroom environment. The lower limit of the some sections may be defined as the first input value I1 and the upper limit of the some sections may be defined as the second input value I2.

On the lower graph of FIG. 5C, a blue gamma vs. the value of the grayscale (e.g., gray level) input data of the blue image signal B in the darkroom environment, namely, the level of a blue data level VB, is shown as a third reference gamma curve BRGC, and a green gamma to the grayscale (e.g., gray level) input of the blue image signal B to be applied to the liquid crystal display apparatus in the blue lighting environment, namely, the level of the blue data level VB, is shown as a third controlled gamma curve BCGC. As shown in FIG. 5C, the third controlled gamma curve BCGC is different from the third reference gamma curve BRGC only in the some sections that are defined by the first input value I1 and the second input value I2.

Like the color gamut ratio graph shown in FIG. 2, as blue lighting becomes stronger, the width of the some sections widens. In addition, as the blue lighting becomes stronger, the difference between the third controlled gamma curve BCGC and the third reference gamma curve BRGC becomes larger. Thus, as the blue lighting becomes stronger, the blue pixels of the liquid crystal display apparatus 200 emit a stronger blue light and the blue color of the liquid crystal display apparatus 200 is highlighted. Thus, a decrease in visibility of an image due to a phenomenon where the human eyes become less sensitive to a blue color under blue lighting may be reduced.

As previously described with reference to FIGS. 5A to 5C, a decrease in visibility of an image due to a phenomenon where the human eyes become less sensitive to the same color as that of surrounding lighting under red, green, or blue lighting may be improved. In addition, even though ambient light is not a single-color light, the liquid crystal display apparatus according to the present embodiment operates properly. If the ambient light is a mixed-color light, namely, a white light, when the illumination of the ambient light is high, a high level of red light, a high level of green light, and a high level of blue light may be included in the ambient light. In this case, the liquid crystal display apparatus according to the present embodiment may increase the luminescence of red light emitted from red pixels by using the first controlled gamma curve RCGC in response to a high level of red light, increase the luminescence of green light emitted from green pixels by using the second controlled gamma curve GCGC in response to a high level of green light, and increase the luminescence of blue light emitted from blue pixels by using the third controlled gamma curve BCGC in response to a high level of blue light. That is, if the illumination of the ambient light increases, the liquid crystal display apparatus may correspondingly increase the luminescence of red, green, and blue lights as long as a color space coordinate is not distorted. Thus, a color gamut ratio in addition to visibility may be improved.

FIGS. 5A to 5C refer to color space coordinates but the color gamut ratio shown in FIG. 2 may be defined by a color space coordinate for a light that a display apparatus may represent. Thus, the features previously described with reference to FIG. 2 may be equally valid for the embodiments of FIGS. 5A to 5C, if compatible.

Figure 6:
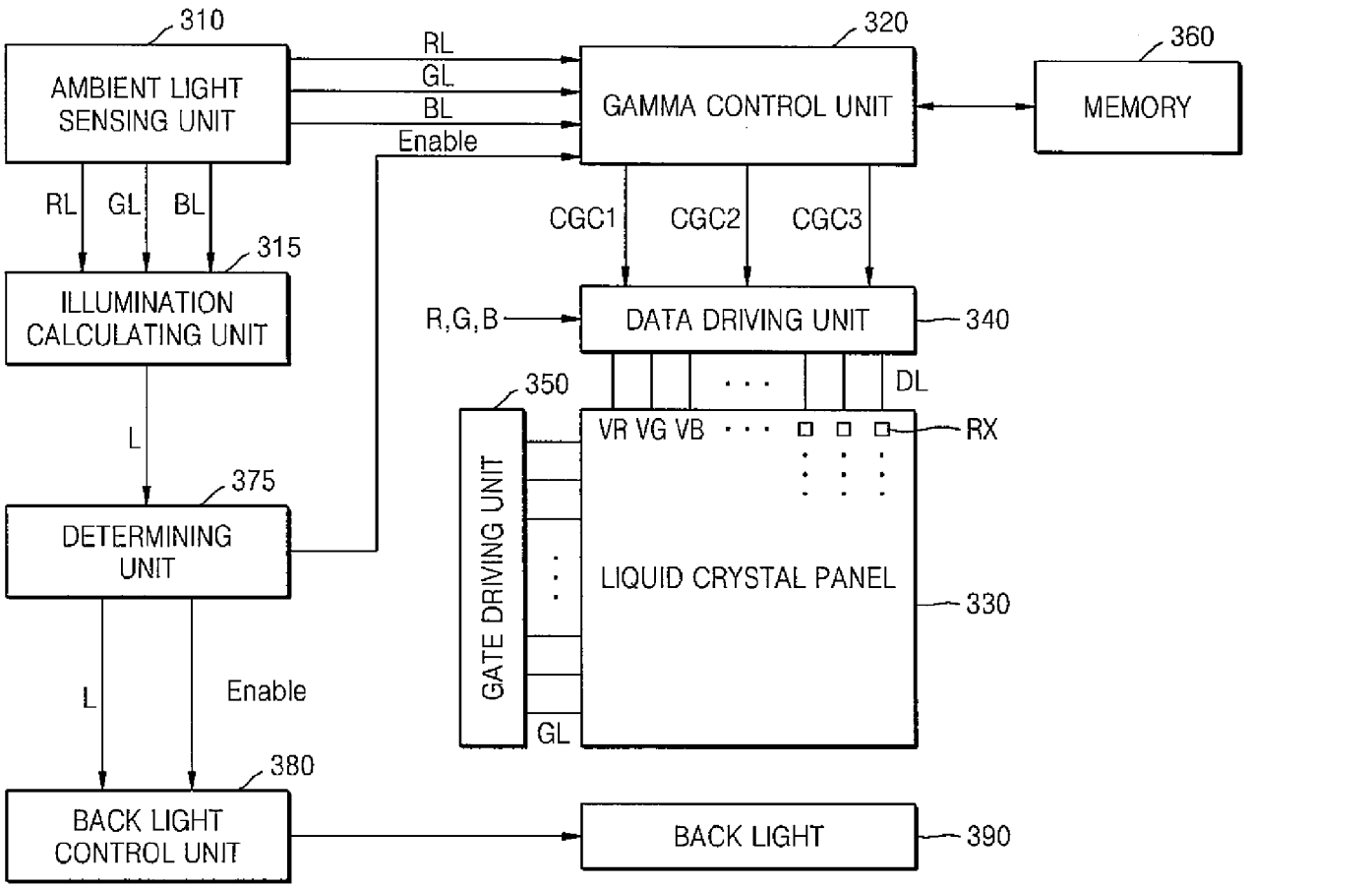
FIG. 6 is a schematic block diagram of a liquid crystal display apparatus according to still another embodiment.

FIG. 6 is a schematic block diagram of a liquid crystal display apparatus according to still another embodiment.

Referring to FIG. 6, the liquid crystal display apparatus 300 includes a liquid crystal panel 330, a backlight 390, an ambient light sensing unit (or ambient light sensor) 310, an illumination calculating unit (or illumination calculator) 315, a determining unit 375, a backlight control unit (or backlight controller) 380, a gamma control unit (or gamma controller) 320, a data driving unit (or data driver) 340, and a gate driving unit (or gate driver) 350.

The liquid crystal panel 330 includes red pixels, green pixels, and blue pixels. The backlight 390 emits a light from the back surface of the liquid crystal panel 330. The ambient light sensing unit 310 measures the amount of red light, the amount of green light, and the amount of blue light in ambient light around the liquid crystal panel 330, and generates red light amount information RL corresponding to the amount of red light, green light amount information GL corresponding to the amount of green light, and blue light amount information BL corresponding to the amount of blue light. The illumination calculating unit 315 receives the red light amount information RL, the green light amount information GL, and the blue light amount information BL and calculates the illumination L of the ambient light based on the red light amount information RL, the green light amount information GL, and the blue light amount information BL.

The determining unit 375 compares the illumination L of the ambient light with preset critical illumination and determines a correction mode as one of a first correction mode and a second correction mode according to a comparison result. The backlight control unit 380 controls the luminescence of the backlight 390 based on the illumination L of the ambient light, in the first correction mode. The gamma control unit 320 controls first some sections of a first reference gamma curve based on the red light amount information RL to generate a first controlled gamma curve CGC1, controls second some sections of a second reference gamma curve based on the green light amount information RL to generate a second controlled gamma curve CGC2, and controls third some sections of a third reference gamma curve based on the blue light amount information RL to generate a third controlled gamma curve CGC3, in the second correction mode.

The data driving unit 340 converts a red image signal R into a red data voltage VR based on the first controlled gamma curve CGC1, supplies the red data voltage VR to the red pixels, converts a green image signal G into a green data voltage VG based on the second controlled gamma curve CGC2, supplies the green data voltage VG to the green pixels, converts a blue image signal B into a blue data voltage VB based on the third controlled gamma curve CGC3, and supplies the blue data voltage VB to the blue pixels, in the second correction mode. The gate driving unit 350 supplies a gate signal to the red pixels, the green pixels, and the blue pixels.

The liquid crystal panel 330, the backlight 390, the ambient light sensing unit 310, the illumination calculating unit 315, the backlight control unit 390, the gamma control unit 320, the data driving unit 340, and the gate driving unit 350 of the liquid crystal display apparatus 300 are respectively substantially the same or similar as the liquid crystal 230, the backlight 290, the ambient light sensing unit 210, the illumination calculating unit 215, the backlight control unit 280, the gamma control unit 220, the data driving unit 240, and the gate driving unit 250 of the liquid crystal display apparatus 200. Thus, description of some of the similar features is not repeated.

The determination unit 375 compares the illumination L of the ambient light with preset critical illumination and determines a correction mode. The correction mode includes a first correction mode and a second correction mode. The first correction mode operates if the illumination L of the ambient light is higher than the preset critical illumination. The second correction mode operates if the illumination L of the ambient light is lower than the preset critical illumination. The preset critical illumination may be an illumination value that identifies an indoor environment and an outdoor environment. For example, the preset critical illumination may be set to a value between 1000 nit and 10000 nit. For example, the preset critical illumination may be 5000 nit.

If the determining unit 375 determines the correction mode as the first correction mode, it is possible to transmit a signal associated with the illumination L of ambient light and an enable signal Enable to the backlight control unit 380. The backlight control unit 380 may control the luminescence of the backlight 390 according to the illumination L of the ambient light in response to the enable signal Enable provided from the determining unit 375. The backlight control unit 380 may increase the luminescence of the backlight 390 if the illumination L of the ambient light is high. Thus, by increasing the luminescence of the backlight 390 in response to high illumination in an environment having high illumination such as an outdoor environment, it is possible to improve the visibility of an image displayed on the liquid crystal display apparatus 300.

According to one embodiment, in the first correction mode, the gamma control unit 320 may be inactivated and the first to the third controlled gamma curves (CGC1 to CGC3) may not be generated. In this case, the data driving unit 340 may convert the red image signal R into the red data voltage VR based on the first reference gamma curve, supply the red data voltage VR to the red pixels of the liquid crystal panel 330, convert the green image signal G into the green data voltage VG based on the second reference gamma curve, supply the green data voltage VG to the green pixels of the liquid crystal panel 330, convert the blue image signal B into the blue data voltage VB based on the third reference gamma curve, and supply the blue data voltage VB to the blue pixels of the liquid crystal panel 330.

According to another embodiment, even though the determining unit 375 determines the correction mode as the first correction mode, both the backlight control unit 380 and the gamma control unit 320 may be activated.

If the determining unit 375 determines the correction mode as the second correction mode, it is possible to transmit the enable signal Enable to the gamma control unit 320. The gamma control unit 320 operates in the same way as the gamma control unit 220 described with reference to FIG. 4, generates the first controlled gamma curve CGC1 based on the red light amount information RL, generates the second controlled gamma curve CGC2 based on the green light amount information GL, and generates the third controlled gamma curve CGC3 based on the blue light amount information BL. The first controlled gamma curve CGC1 generated by the gamma control unit 320 is used for converting the red image signal R into the red data voltage VR, and the data driving unit 340 supplies the red data voltage VR to the red pixels of the liquid crystal panel 330. The second controlled gamma curve CGC2 generated by the gamma control unit 320 is used for converting the green image signal G into the green data voltage VG, and the data driving unit 340 supplies the green data voltage VG to the green pixels of the liquid crystal panel 330. The third controlled gamma curve CGC3 generated by the gamma control unit 320 is used for converting the blue image signal B into the blue data voltage VB, and the data driving unit 340 supplies the blue data voltage VB to the blue pixels of the liquid crystal panel 330.

Thus, when ambient light has a specific color coordinate, the possibility that a viewer wrongly perceives an image displayed on the liquid crystal display apparatus 300 may be reduced. That is, the visibility or image display quality of the liquid crystal display apparatus 300 is improved.

According to one embodiment, the liquid crystal display apparatus 300 may further include a memory 360. The memory 360 corresponds to the memory 260 previously described with reference to FIG. 4 and thus some repetitive descriptions thereof are omitted. The memory 360 may store a plurality of first controlled gamma curves defined according to red light amounts, a plurality of second controlled gamma curves defined according to green light amounts, and a plurality of third controlled gamma curves according to blue light amounts.

According to various embodiments of the present invention, the color gamut ratio of the display apparatus is improved by preventing or reducing decrease thereof due to ambient light. In addition, distortion of an image displayed on the liquid crystal display apparatus due to ambient light is also reduced.

Although the specification mainly illustrates various embodiments of the liquid crystal display apparatus, it should be noted that the present invention may be also applied to various display apparatuses such as an organic light-emitting display apparatus. Also, although the specification mainly describes the present invention with reference to the above embodiments, other various embodiments may be made within the scope of the present invention. In addition, equivalent elements may also be combined with the present invention. Thus, the true, protective scope of the present invention is defined by the following claims, and their equivalents.

What is claimed is:

1. A display apparatus comprising:

a panel comprising a plurality of pixels configured to display an image;

an ambient light sensor configured to sense an illumination level of ambient light and to generate ambient light data;

a gamma controller configured to control a section of a reference gamma curve based on the ambient light data to generate a controlled gamma curve, the controlled gamma curve defining a relationship between output data voltages and input values;

a data driver configured to convert an image signal into a data voltage based on the controlled gamma curve and to supply the data voltage to the pixels; and a gate driver configured to supply a gate signal to the pixels, wherein the section of the reference gamma curve corresponds to a range of input values more than or equal to a first input value and less than or equal to a second input value larger than the first input value, and wherein the range is broader as the illumination level of the ambient light increases.

2. The display apparatus of claim 1, wherein the range of input values is defined such that a color gamut ratio of the panel under an environment having a same illumination level as the ambient light with respect to the input values is lower by a reference value than a color gamut ratio of the panel under a darkroom environment.

3. The display apparatus of claim 1, wherein the first and second input values are defined according to the illumination level of the ambient light.

4. The display apparatus of claim 1, wherein the first input value remains constant or increases as the illumination level of the ambient light increases, and the second input value remains constant or increases as the illumination level of the ambient light increases.

5. The display apparatus of claim 1, wherein if an input value is in the range of input values, a reference output data voltage according to the reference gamma curve is different from a controlled output data voltage according to the controlled gamma curve, and if an input value is outside the range of input values, the reference output data according to the reference gamma curve is equal to the controlled output data according to the controlled gamma curve.

6. The display apparatus of claim 5, wherein minimum and maximum values of the input values are outside the range of input values.

7. The display apparatus of claim 1, wherein a section of the controlled gamma curve corresponding to the range of input values has a constant slope.

8. The display apparatus of claim 1, a slope value of the controlled gamma curve at the first input value is more than a slope value of the reference gamma curve at the first input value, a slope value of the controlled gamma curve at the second input value is less than a slope value of the reference gamma curve at the second input value, and slope values of a section of the controlled gamma curve corresponding to the range of input values increases.

9. The display apparatus of claim 1, further comprising a memory configured to store a plurality of controlled gamma curves that are each defined according to an illumination level of the ambient light, and wherein the gamma controller is configured to select from the memory one of the controlled gamma curves corresponding to the ambient light data.

10. The display apparatus of claim 1, wherein the ambient light sensor is an illumination sensor configured to measure the illumination level of the ambient light.

11. A display apparatus comprising:

a panel comprising first pixels, second pixels, and third pixels;

an ambient light sensor configured to measure a first light amount, a second light amount, and a third light amount in ambient light around the panel, the ambient light sensor configured to generate first light amount data corresponding to the first light amount, second light amount data corresponding to the second light amount, and third light amount data corresponding to the third light amount;

a gamma controller configured to:

control a first section of a first reference gamma curve based on the first light amount data to generate a first controlled gamma curve, control a second section of a second reference gamma curve based on the second light amount data to generate a second controlled gamma curve, and control a third section of a third reference gamma curve based on the third light amount data to generate a third controlled gamma curve;

a data driver configured to:

convert a first image signal into a first data voltage based on the first controlled gamma curve and to supply the first data voltage to the first pixels, convert a second image signal into a second data voltage based on the second controlled gamma curve and to supply the second data voltage to the second pixels, and convert a third image signal into a third data voltage based on the third controlled gamma curve and to supply the third data voltage to the third pixels; and a gate driver configured to supply a gate signal to the first pixels, the second pixels, and the third pixels, wherein the first section of the first reference gamma curve corresponds to a first range of input values more than or equal to a first input value and less than or equal to a second input value larger than the first input value, wherein the second section of the second reference gamma curve corresponds to a second range of input values more than or equal to a third input value and less than or equal to a fourth input value larger than the third input value, wherein the third section of the third reference gamma curve corresponds to a third range of input values more than or equal to a fifth input value and less than or equal to a sixth input value larger than the fifth input value, wherein the first range of input values is broader as the first light amount increases in the ambient light, wherein the second range of input values is broader as the second light amount increases in the ambient light, and wherein the third range of input values is broader as the third light amount increases in the ambient light.

12. The display apparatus of claim 11, wherein the first and second input values are defined based on the first light amount data, the third and fourth input values are defined based on the second light amount data, and the fifth and sixth input values are defined based on the third light amount data.

13. The display apparatus of claim 11, wherein the first range of input values is defined such that a color space coordinate value measured on the panel on which only the first pixels are turned on under a first lighting environment corresponding to the first light amount data is more different by a first reference value than a color space coordinate value measured on the panel on which only the first pixels are turned on under a darkroom environment, the second range of input values is defined such that a color space coordinate value measured on the panel on which only the second pixels are turned on under a second lighting environment corresponding to the second light amount data vary with respect to color space coordinates measured on the panel on which only the second pixels are turned on under the darkroom environment, the third range of input values is defined such that a color space coordinate value measured on the panel on which only the third pixels are turned on under a third lighting environment corresponding to the third light amount data is more different by a third reference value than a color space coordinate value measured on the panel on which only the third pixels are turned on under the darkroom environment.

14. The display apparatus of claim 11, wherein as the first light amount increases in the ambient light, a difference between the first reference gamma curve and the first controlled gamma curve increases, as the second light amount increases in the ambient light, a difference between the second reference gamma curve and the second controlled gamma curve increases, and as the third light amount increases in the ambient light, a difference between the third reference gamma curve and the third controlled gamma curve increases.

15. The display apparatus of claim 11, wherein the first pixels, the second pixels, and the third pixels correspond to red pixels, green pixels, and blue pixels, respectively.

* * * * *